US009660378B2

(12) United States Patent
Silvers et al.

(10) Patent No.: US 9,660,378 B2
(45) Date of Patent: May 23, 2017

(54) MAGNETIC ELECTRICAL CONNECTOR

(71) Applicants: Zachary Silvers, Fort Lauderdale, FL (US); Rodrigo Lima, Fort Lauderdale, FL (US)

(72) Inventors: Zachary Silvers, Fort Lauderdale, FL (US); Rodrigo Lima, Fort Lauderdale, FL (US)

(73) Assignee: Simple Socket Inc., Fort Lauderdale, FL (US)

( * ) Notice: Subject to any disclaimer, the term of this patent is extended or adjusted under 35 U.S.C. 154(b) by 0 days.

(21) Appl. No.: 15/272,178

(22) Filed: Sep. 21, 2016

(65) Prior Publication Data

US 2017/0085028 A1 Mar. 23, 2017

Related U.S. Application Data

(60) Provisional application No. 62/221,944, filed on Sep. 22, 2015.

(51) Int. Cl.

| | |
|---|---|
| ***H01R 13/62*** | (2006.01) |
| ***H01R 24/70*** | (2011.01) |
| ***H01R 13/05*** | (2006.01) |
| ***H01R 13/11*** | (2006.01) |
| ***H01R 13/502*** | (2006.01) |
| ***H01R 13/516*** | (2006.01) |

(52) U.S. Cl.

CPC ..... *H01R 13/6205* (2013.01); *H01R 13/055* (2013.01); *H01R 13/113* (2013.01); *H01R 13/502* (2013.01); *H01R 13/516* (2013.01); *H01R 24/70* (2013.01)

(58) Field of Classification Search

None

See application file for complete search history.

(56) References Cited

U.S. PATENT DOCUMENTS

| | | | | |
|---|---|---|---|---|
| 3,521,216 A | | 7/1970 | Tolegian | |
| 3,808,577 A | * | 4/1974 | Mathauser | H01R 13/6205 439/180 |
| 5,876,226 A | | 3/1999 | Tsukakoshi et al. | |
| 7,264,479 B1 | * | 9/2007 | Lee | H01R 11/30 439/39 |

(Continued)

*Primary Examiner* — Truc Nguyen

(57) ABSTRACT

An electrical connector that includes a first part housing for supporting contacting elements each configured to conductively couple with an electrical power source. First part coupling elements are configured to move between a connected and an unconnected configuration. In the connected configuration, each first part coupling element conductively couples with contacting elements, and in the unconnected configuration the first part coupling elements are not conductively coupled with contacting elements. At least one biasing element is configured to maintain the first part coupling elements in the unconnected configuration. A second part housing supports second part coupling elements each configured to conductively couple with one of the first part coupling elements. At least one magnetic element is configured to move and maintain the first part coupling elements into the connected configuration, wherein in the connected configuration electrical current can flow from the contacting elements to the second coupling elements.

20 Claims, 20 Drawing Sheets

(56) References Cited

U.S. PATENT DOCUMENTS

| | | | | |
|---|---|---|---|---|
| 2002/0160629 | A1* | 10/2002 | Lau | H01R 13/4534 439/39 |
| 2008/0305649 | A1 | 12/2008 | Didur | |
| 2011/0159705 | A1* | 6/2011 | Schmidt | H01R 11/30 439/39 |
| 2011/0244706 | A1 | 10/2011 | Rohde et al. | |
| 2012/0071008 | A1* | 3/2012 | Sessford | H01R 13/6205 439/39 |
| 2013/0295781 | A1* | 11/2013 | Gualino | H01R 13/2421 439/39 |
| 2014/0099808 | A1* | 4/2014 | McClelland | H01R 13/6205 439/153 |
| 2014/0120746 | A1* | 5/2014 | Persion | G02B 6/3817 439/39 |
| 2014/0235075 | A1 | 8/2014 | Kim et al. | |
| 2014/0302691 | A1 | 10/2014 | Janfada et al. | |
| 2014/0321040 | A1 | 10/2014 | Rutter | |
| 2015/0318638 | A1* | 11/2015 | McClelland | H01R 13/629 439/105 |
| 2015/0333458 | A1* | 11/2015 | Hallsten | H01R 24/58 439/39 |

* cited by examiner

MAGNETIC ELECTRICAL CONNECTOR

CROSS-REFERENCE TO RELATED APPLICATIONS

This patent application claims priority to provisional patent application No. 62/221,944 filed Sep. 22, 2015. The subject matter of patent application No. 62/221,944 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The present invention relates to the field electrical connectors, and more electrical connectors used to couple power sources to electrical devices.

BACKGROUND

Electrical connectors have been used to connect electrical devices to power sources for many years. For example, one type of electrical connector used to conductively couple appliances, such as vacuums, television sets, refrigerators etc. to a power source includes a power plug and a power socket. Other examples of electrical devices that can be connected to power sources include light bulbs, cellular telephones, washing machine and dryer machines etc.

One limitation of the existing electrical connectors is that when the power plug of a device is connected to the electrical socket, the electrical socket is such that it provides a limited range of motion of the plug or a fixed and stationary position in relation to the plug. This is because of the fixed arrangement of the prongs of the power plug within the electrical socket.

Another limitation of the existing electrical connectors is that it may be difficult for users with physical challenges to insert a power plug into electrical socket. In many cases electrical sockets on walled surfaces are positioned proximate to the floor. When this is the case, a user is often forced to bend down in order to insert the prongs of the power plug into an electrical socket. For persons with physical disabilities or injuries, this may be a difficult or impossible task.

Additionally, another limitation of existing electrical connectors is that the electrical connectors do not have an easy breakaway feature. In certain cases, it is advantageous to allow the electrical plug to be removed or disengaged safely if a strong or great force acts on the plug. For example, a user may accidently trip over a power cord causing the power cord to be ripped haphazardly out of the wall, damaging the prongs and/or the electrical socket or even worse, contributing to trip injuries due to extremely strong force required to disengage a plug from a traditional socket. Currently, the existing electrical sockets and power plugs do not have a break away feature that would allow the power cord and plug to be safely and easily disengaged or removed from the electrical socket without damaging components of the electrical connectors.

As a result, there exists a need for improvements over the prior art and more particularly for a more efficient and convenient way of providing an electrical connection between a power source and an electrical device.

SUMMARY

An electrical connector for connecting a power source to an electrical device is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an electrical connector for connecting a power source to an electrical device is disclosed. The electrical connector includes a first part housing configured for supporting a plurality of contacting elements. Each contacting element is configured to conductively couple with an electrical contact of an electrical power source. The first part housing also supports a plurality of first part coupling elements. Each first part element has conductive properties and is configured to move between a connected configuration and an unconnected configuration. In the connected configuration, each first part coupling element conductively couples with one of the contacting elements. In the unconnected configuration, the first part coupling elements are not conductively coupled with the contacting elements. The first part housing also supports or includes within the housing at least one biasing element. Each biasing element provides a first biasing force configured to maintain the first part coupling elements in the unconnected configuration.

The electrical connector also includes a second part housing configured for supporting a plurality of second part coupling elements. Each second part coupling element is configured to conductively couple with one of the first part coupling elements when the first part coupling elements are in the connected configuration. The second part also includes or supports at least one magnetic element providing a magnetic force greater than the biasing force such that when the first part housing and the second part housing are within a sufficient proximity, the second magnetic force moves and maintains the first part coupling elements into the connected configuration and couple the first part housing to the second part housing. In the connected configuration, the first part coupling elements are conductively coupled with the second part coupling elements such that electrical current can flow from the contacting elements to the second coupling elements.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1A:
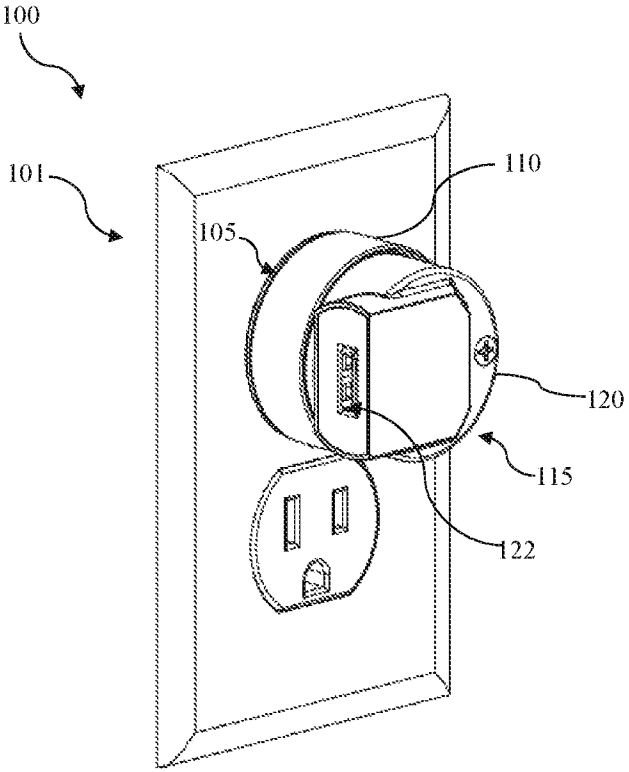
FIG. 1A is a perspective view of the electrical connector inserted into an electrical wall socket, according to a non-limiting example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing an electrical connector that connects a power source to an electrical device using electromagnetic or magnetic forces to couple the components of the housing of the connectors. The disclosed electrical connectors include magnetic elements or a biasing element that provides a first magnetic force or biasing force that is configured to safely keep the conductive components within the housing and out of reach when the device is not in use. The disclosed electrical connector also includes magnetic elements that provide a second magnetic force that safely move the coupling elements into a connected position thereby allowing power to safely flow from the power source to the electrical devices attached to the second part housing of the device. The disclosed electrical connector also allows a user to easily and magnetically connect the first and second parts of the housing by simply having the first and second housings in closed proximity to each other and without having to apply a significant amount of force. This is important because it allows users with physical disabilities to more easily connect electrical devices with power sources without having to (in certain instances) bending low, or reaching high above a user's body, to plug the prongs of an electrical plug or other connecting components into the electrical socket. The present embodiment allows a disabled user to attach the first part of the housing to an electrical power source, and move or swing the second part of the housing in proximity to the first part of the housing to easily make an electrical connection. The present embodiment also includes a locking feature and covering elements that provide an additional safety feature that prevent accidental shock, especially to children who may fiddle the device when the device is coupled to a power source.

Referring now to the Figures, FIG. 1A is a perspective view of the electrical connector 100 inserted into an electrical wall socket 101, according to a non-limiting example embodiment. The electrical connector is for connecting a power source to an electrical device. The power source may be power generated by an electrical energy grid, battery, rechargeable battery, lithium battery, fuel-cell system, generator, etc. In the present embodiment, the electrical connector is configured for providing power in a 120 V configuration. However, it is understood and within the spirit and scope of the present invention that the device may be configured to be used with different voltages, including, but not limited to 5V, 120 V, 240 V, 120 V, 208 V, 277 V, 400 V, 480 V, 347 V, 600 V, and the present embodiment is only a non-limiting example embodiment.

The electrical device (not shown) used with the electrical connector can be virtually any type of electrical devices. For example, an electrical device may be a mobile phone, a computer, appliances, electrical lightbulbs, televisions, or any other device that requires electrical current to operate. Electrical connector comprises a first part 105 that is configured to couple with the second part 115. The first part comprises a first part housing 110. The first part housing is configured for supporting components of the first part. The second part housing 120 is configured for housing the components of the second part. In the present embodiment, the first part housing is configured to be inserted to an electrical socket. However, as explained in the specification below and in subsequent figures, the first part housing maybe also configured to be inserted into electrical socket of a variety different electrical appliances, such as a lighting fixture etc. (further explained below and also illustrated in FIGS. 9 and 10). In the present embodiment, the second part housing is configured to receive the electrical contacting elements of a plug of an electrical device. FIG. 1A illustrates that the second part has an opening 122 comprising electrical contacts configured to receive the electrical contacting elements of the terminating end of a USB power cord, which is well known to those skilled in the art.

Figure 1B:
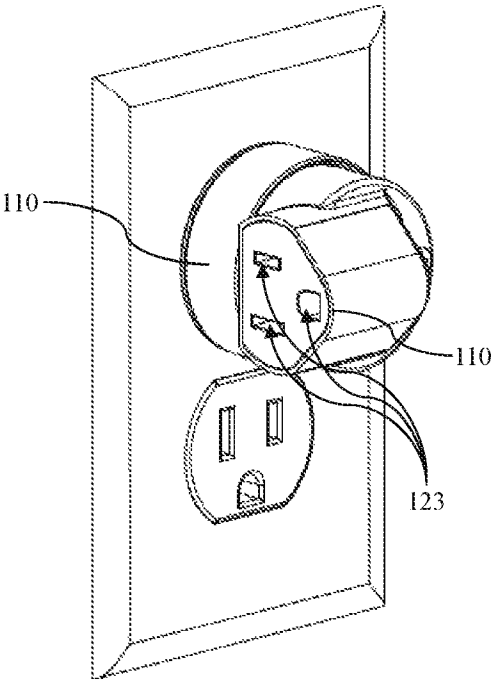
FIG. 1B is a perspective view of the electrical connector inserted into an electrical wall socket, according to a second non-limiting example embodiment.

FIG. 1B is a perspective view of the electrical connector 100 inserted into an electrical wall socket, according to a second non-limiting example embodiment. In FIG. 1B, the second part housing 110 comprises openings 123 that are configured for receiving the electrical contacts of a power cord configured to provide 120 V power. Similar to FIG. 1A, the first part housing 105 supports the components of the first part, which is configured to couple with the second part housing 110 of the second part.

Figure 2B:
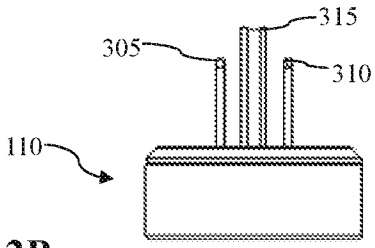
FIG. 2B is a first view of the first part of the electrical connector, according to a non-limiting example embodiment.
Figure 2C:
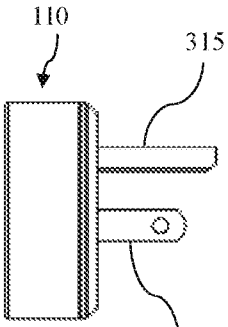
FIG. 2C is a second view of the first part of the electrical connector, according to a non-limiting example embodiment.
Figure 2A:
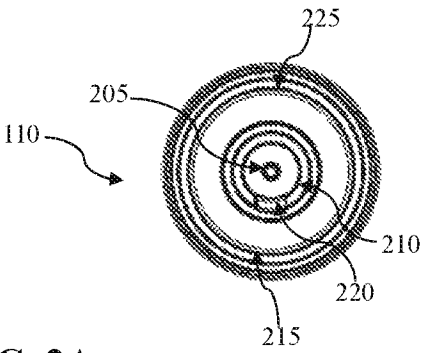
FIG. 2A is a top view of the first part of the electrical connector, according to a non-limiting example embodiment.

FIG. 2A-2C are top and side views, respectively, of the first part of the electrical connector. As mentioned above, the first part housing 110 of the electrical connector supports the components of the first part of the electrical connector. The pronged portions of the first part are configured to be inserted into a standard electrical socket. The pronged sections of the contacting elements 305, 310 correspond to the hot or live leg and the neutral leg, respectively of the electrical power source. The pronged section or ground section 315 corresponds to ground of the electrical power source. The pronged sections of the contacting elements and pronged ground are exposed outside of the first part of the housing. The internal sections of the contacting elements are configured to conductively couple with corresponding coupling elements 351, 352 and will further be explained below.

Opposing the pronged sections of the contacting elements on the first housing are surfaces that are configured to mate with the second part 115. In the present embodiment, the first part housing is a substantially cylindrical shaped housing. However, it is understood that other shapes may also be used and are within the spirit and scope of the present invention. The first surface of the first part that is configured to mate with the second part comprises a central opening 205. The central opening is configured to allow the second part coupling element for the live or hot leg 207 (further explained below) to couple with the first part live or hot leg coupling element 352 of the first part. In the present embodiment, the central opening 205 comprises a cylindrical shape, however, it is understood that the central opening the comprise a variety of different shapes that are within the spirit and scope of the present invention. It is also understood that while the central opening or opening 205 is centrally located on the housing, it is understood that the housing and other elements may be designed such that the opening is positioned elsewhere along the first part housing.

FIG. 2A also illustrates that a first channel 210 that is co-centric with a second outside channel 215. The first channel is configured for receiving the ring 420 of the second part coupling element and the second channel is configured for receiving the second part ground connecting element 415 of the second part (further explained below). The first channel 210 comprises a second opening 220. Analogous to the first or central opening 205, the second opening is configured for allowing the neutral leg coupling element 351 of the first part to couple with the ring 420 of the second part (further explained below). Analogous to the first and second openings, a third opening 225 is disposed along the second channel. The third opening is configured for allowing the ground coupling element of the first part 357 to conductively couple with the second part ground connecting element 415 (further explained below).

Figure 3A:
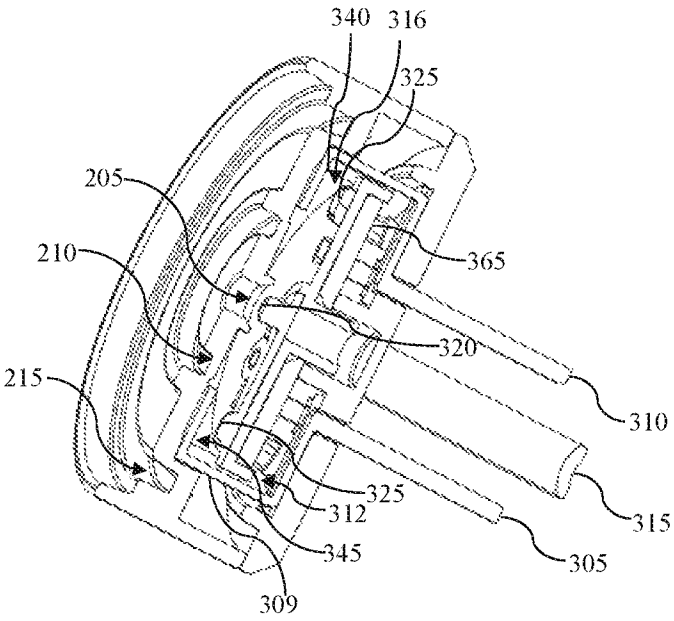
FIG. 3A is a cross-sectional perspective view of the first part of the electrical connector, according to a non-limiting example embodiment.
Figure 3B:
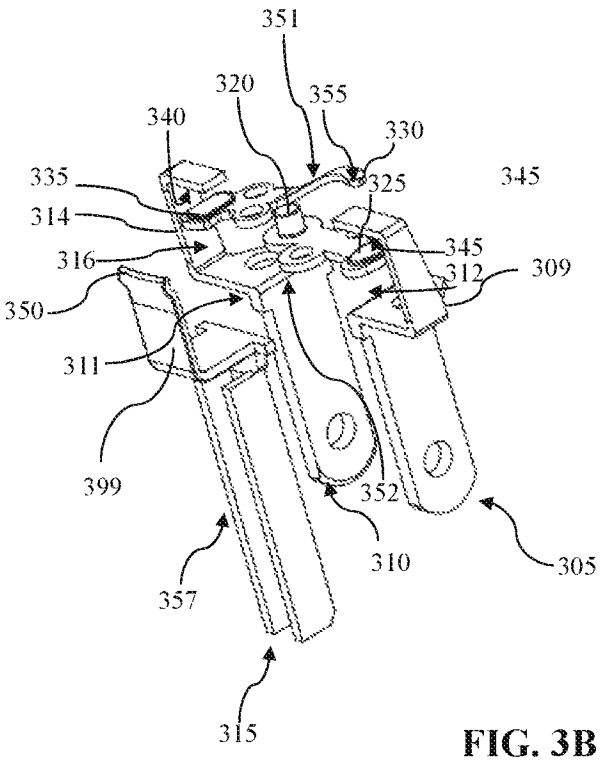
FIG. 3B is a perspective view of the coupling elements and contacting elements, wherein the elements are in an open configuration, according to a non-limiting example embodiment.
Figure 3C:
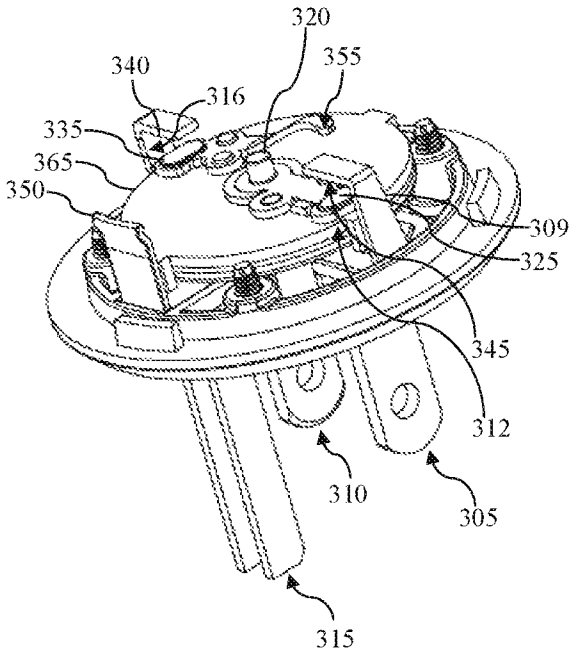
FIG. 3C is a perspective view of the non-conductive planar body with the coupling elements coupled thereto, wherein the coupling elements is an open configuration, according to a non-limiting example embodiment.
Figure 3D:
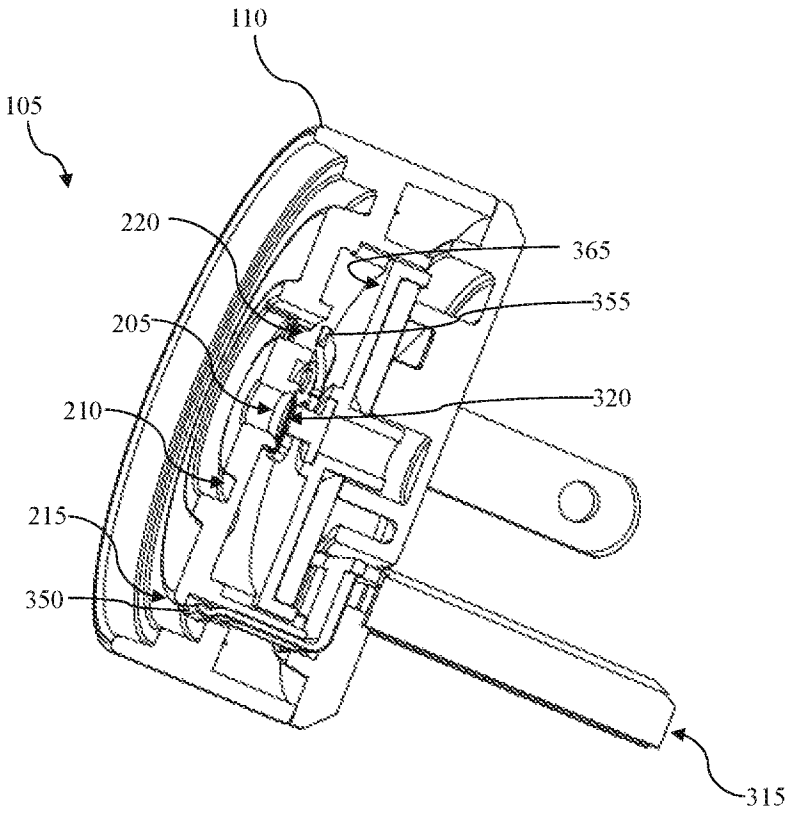
FIG. 3D is a cross-sectional perspective view of the first part of the electrical connector in the un-connected configuration, according to a non-limiting example embodiment.

FIGS. 3A-3D will be discussed together. FIG. 3A is a cross-sectional perspective view of the first part of the electrical connector, according to a non-limiting example embodiment. FIG. 3B is a perspective view of the first part coupling elements 351, 352, contacting elements 306, 311 and first part ground connecting element 357, wherein the coupling elements are in an open configuration, according to a non-limiting example embodiment. FIG. 3C is a perspective view of the non-conductive planar body 365 with the coupling elements coupled thereto, wherein the coupling elements and contacting elements is in an open configuration, according to a non-limiting example embodiment. FIG. 3D is a cross-sectional perspective view of the first part of the electrical connector in the un-connected configuration, according to a non-limiting example embodiment. FIGS. 3A-3D illustrate the first part coupling elements 351, 352 in the unconnected configuration. In the unconnected configuration the first part coupling elements 352, 351 (live leg and neutral leg, respectively) are not conductively coupled with contacting elements 306, 311 (live leg and neutral leg, respectively). In the connected configuration, each first part coupling element conductively couples with one of the contacting elements such that a path for electrical power may flow from electrical power source to the coupling elements. While, in the nonconnected configuration, each first part coupling element is not conductively coupled with the contacting elements and as a result a path for electrical power does not flow from electrical power source to the coupling elements.

In the present embodiment, the plurality of contacting elements each are configured to conductively couple with corresponding contact of electrical power source. The first part contacting elements may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention. In one embodiment, the first part contacting elements comprise at least a hot or live leg contacting element 306 and a neutral leg contacting element 311. In the present embodiment, the hot leg contacting element comprises a pronged section 305 that is configured to extend outside of the first part housing. The hot leg contacting element also comprises a bent or curved element 309 defining a mouth 312. As will be further explained below, the mouth 312 is configured such that the hot leg coupling element can translate therein. A terminating end of the hot leg contacting element also comprises a contact surface 345. The hot leg contact surface is configured to contact a portion of the hot leg coupling element of the first part such that the hot leg coupling element and hot leg contacting elements conductively couple such that a path for electrical power to flow is provided when in the connected configuration (as illustrated in FIG. 5B).

In the present embodiment, the neutral leg contacting element also comprises a pronged section 310 that is configured to extend outside of the first part housing. The neutral leg contacting element also comprises a bent or curved element 314 defining a mouth 316. As will be further explained below, the mouth 316 is configured such that the neutral leg coupling element can translate therein. A terminating end of the neutral leg contacting element also comprises a contact surface 340. The neutral leg contact surface is configured to contact a portion of the neutral leg coupling element of the first part such that the neutral leg coupling element and neutral leg contacting element conductively couple with one another such that a path for electrical power to flow is provided when in the connected configuration.

In the present embodiment, the first part coupling elements 351, 352 each have conductive properties and are configured to move between a connected configuration and unconnected configuration. The coupling elements may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention.

As mentioned above, the first part coupling element comprises a first part hot or live coupling element 352. The first part coupling element comprises a hot leg contact surface 325 for conductively coupling with the contact surface 345 of the hot leg contacting element when in the connected configuration. In the unconnected configuration (as illustrated in FIGS. 3A-3D) the hot leg contact surface 325 is not conductively couple with contact surface 345 of the hot leg contacting element and therefore does not provide electrical path for electrical power to flow to the hot leg contacting element.

In one embodiment, the first part hot leg coupling element also includes a first protruding element 320 that is conductively coupled with the hot leg contact surface. The first protruding element of the first part hot leg coupling element protrudes above the surface of the nonconductive body 365. In the present embodiment, the first protruding element in the present embodiment comprises a cylindrical shaped body that extends upward above the surface of the nonconductive body. The terminating end of the first protruding element is configured to be positioned proximate to the central opening 205 of the first part housing when the coupling element is in the connected configuration (as is further explained below).

The first part coupling element also comprises a first part neutral coupling element 351. The first part neutral coupling element comprises a neutral leg contact surface 335 for conductively coupling with the contact surface 340 of the neutral leg contacting element when in the connected configuration. In the unconnected configuration (as illustrated in FIGS. 3A-3D) the neutral leg contact surface 335 of the coupling element is not conductively coupled with contact surface 340 of the neutral leg contacting element and therefore does not provide electrical path for electrical power to flow to the neutral leg contacting element.

The first part neutral leg coupling element includes a neutral protruding element 330 that is conductively coupled with the neutral leg contact surface 340. The protruding element of the neutral leg coupling element protrudes above the surface of the nonconductive body 365. In the present embodiment, the second or neutral protruding element 330 in the present embodiment comprises an elongated body having a terminating end 355 that is cantilevered above the non-conductive body. In the present embodiment, when the second protruding element 330 is attached to the nonconductive body 365, the cantilevered configuration provides a second biasing element that provides a continuous upwardly biasing force proximate to a terminating end of the second or neutral protruding element away from the surface of the nonconductive body. The terminating end of the second protruding element is configured to be positioned proximate to the second opening 220 of the first part housing when the coupling elements are in the connected configuration.

FIG. 3A-3D also illustrates the first part ground connecting element 357. The first part ground connecting element may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention. The first part ground connecting element also includes a pronged portion 315 that extends outside of the first part housing. The first part ground connecting element also includes a curved or bent portion 399. When fully assembled, as illustrated in FIG. 3D the terminating end of ground connecting element is configured to be positioned such that it is within outer channel 215 on the exterior surface of the first housing. As will be further explained below, the first part ground connecting element is configured to conductively couple with the second ground connecting element 415 of the second part.

In the present embodiment, the first part housing further includes a nonconductive body 365 on the first part coupling elements are disposed. In the present embodiment, the nonconductive body comprises a substantially planar shaped disk. However, it is understood that other shapes and other embodiments for the nonconductive or insulating disc may also be used and are within the spirit and scope of the present invention. The first part coupling elements may be fastened to the nonconductive body or disc 365 using screws, bolts, solder, welding. The nonconductive material may comprise polystyrene, polyurethane, fiberglass, plastic, calcium silicate, stone, vermiculite, glass, foam, or any other material having nonconductive and insulating properties.

When in the unconnected configuration, the first coupling elements are configured to remain within the housing such that the terminating ends of the first protruding element and second protruding element are within the first housing.

Figure 4:
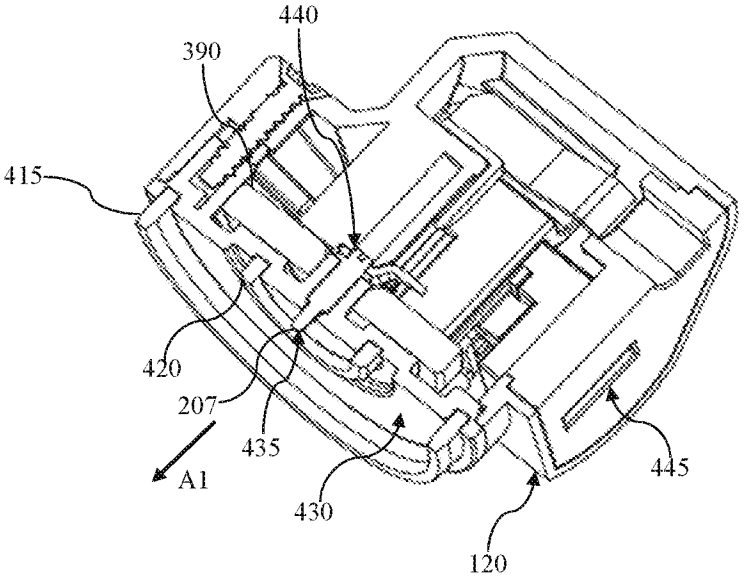
FIG. 4 is a cross-sectional perspective view of the second part of the electrical connector, according to a non-limiting example embodiment.
Figure 5B:
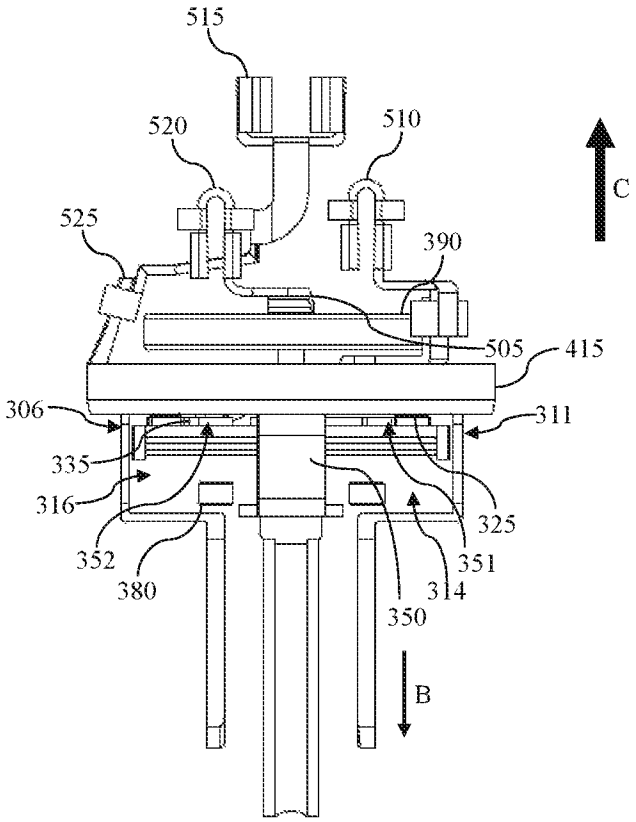
FIG. 5B is a side view of conductive elements of the first part and the second part in the connected state, wherein the first part and second housings are not shown for illustrative purposes, according to a non-limiting example embodiment.
Figure 6:
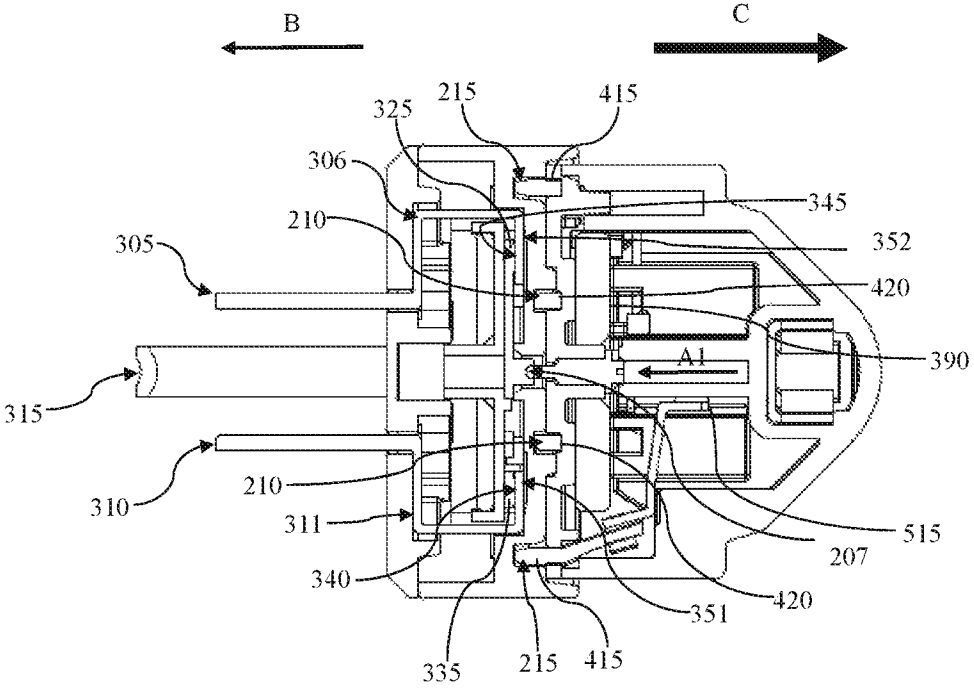
FIG. 6 is a cross-sectional side view of the first and second parts of the electrical connecter coupled to each other and in the connected configuration, according to a non-limiting example embodiment.

FIG. 4 is a cross-sectional perspective view of the second part 115 of the electrical connector, according to a non-limiting example embodiment. The housing 120 of the second part is configured for supporting the components of the second part. The second part housing includes second part coupling elements each configured to conductively couple with one of the first part coupling elements when the first part coupling elements are in the connected configuration and the second part is mated with the first part as will further be explained below and as illustrated in FIGS. 5B and 6.

The second part coupling element comprises a second part protruding element 207. The second part protruding element is positioned such that the terminating end 435 of the second part protruding element extends beyond the first surface 430 of the second housing. However, it is understood that other elements configured to protrude beyond the first surface 430 may also be used and are within the spirit and scope of the present invention.

In one embodiment, the second part protruding element further comprises a third biasing element. In one embodiment, the third biasing element may comprise a biasing spring or compression spring that is configured to continuously force a terminating end 435 of the second part protruding element above the first surface 430 of the housing in the direction of arrow A1. The direction of arrow A1 is intended to be aligned with the longitudinal axis of the second part housing. In operation, when the first part and second part couple with each other, the third biasing force provided by the compression spring continuously biases or moves the terminating end of the second part protruding element towards and into the central opening 205 of the first part housing such that second protruding elements contacts and conductively couples with first protruding element 320 of the first part coupling element hot or live leg contacting element 352. The second end 440 of the second part protruding element is configured to conductively couple with a conductor that terminates within the opening 445 of the second part housing, which said conductor is configured to conductively couple with the live or hot conductor of a power cord of an electrical device. As a result, the first part and the second part are coupled to each other and in the connected configuration, the electrical connector provides a continuous path for electrical current to flow from the hot or live leg of a power source to the conductor terminal within the opening 445. In the present embodiment, the opening 445 is configured to receive the terminating end of a USB power cord, however it is understood that the openings may be adapted such that it can receive plugs configured for devices utilizing different voltages including, but not limited to 120 V, 240 V, 120 V, 208 V, 277 V, 400 V, 480 V, 347 V, 600 V. The second part protruding element may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention.

The second part coupling elements also includes a ring 420 that protrudes beyond the first surface 430 of the first side of the second part housing. In the present invention, the ring surrounds the second part protruding element. However, it is understood that other shapes and positions of the ring may also be used and are within the spirit and scope of the present invention. The ring is configured to be received by the first channel 210 of the first part housing. Additionally, a portion of the ring that extends beyond the first surface 430 of the second housing and into the first channel 210 and is configured to conductively couple with the neutral leg contacting element 351 of the first part coupling element when the first part coupling elements are in the connected configuration and proximate to the second opening 220 of the first channel. Additionally, the ring 420 is configured to conductively couple with a conductor that terminates within the opening 445 of the second part housing, which said conductor is configured to conductively couple with neutral conductor of a power cord of an electrical device. As a result, when the first part and the second part are coupled to each other and in the connected configuration, the electrical connector provides a continuous path for electrical current to flow from the neutral leg of a power source to the conductor terminal within the opening 445. The ring may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention.

FIG. 4 also illustrates the includes a second part ground connecting element 415. In FIG. 4 the second part ground connecting element is an outer ring 415 positioned such that it extends beyond or above the first surface 430 of the second part housing. In operation, when the first part housing mates or couples with the second part housing, outer ring 415 is received by channel 215 of the first part housing. When the outer ring is received within the channel 215, the outer ring conductively couples with the first part ground connecting element 350 that is exposed by the third opening of 225. As a result, when the first part housing in second part housing are couple with each other, the first part ground connecting element conductively couples with the second part ground connecting element or outer ring 415.

Figure 5A:
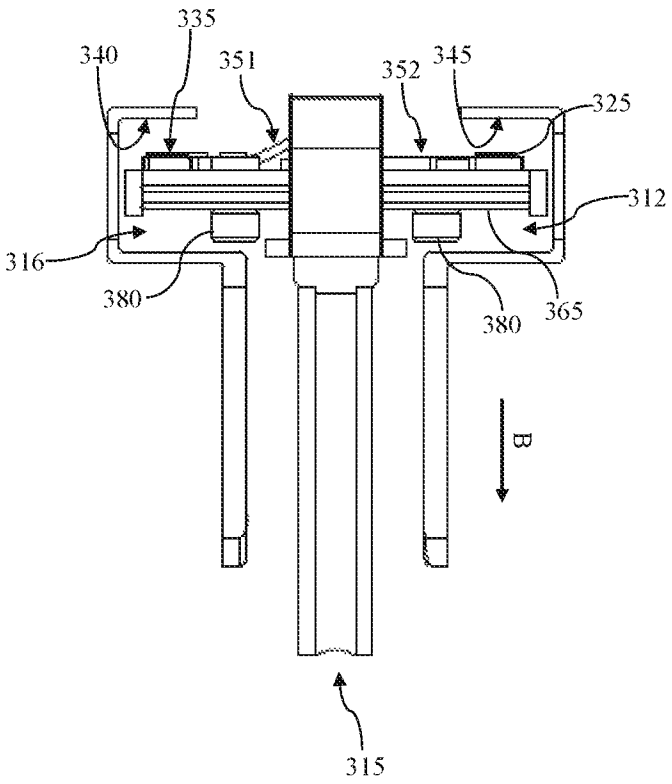
FIG. 5A is a side view of conductive elements of the first part in the unconnected state, wherein the first part housing is not shown for illustrative purposes, according to a non-limiting example embodiment.

FIG. 5A is a side view of conductive elements of the first part in the unconnected configuration, wherein the first part housing is not shown for illustrative purposes, according to a non-limiting example embodiment. Similarly, FIG. 5B is a side view of conductive elements of the first part and the second part in the connected configuration, wherein the first part and second housings are not shown for illustrative purposes, according to a non-limiting example embodiment. The electrical connector includes at least one biasing element. The at least biasing element provides a first biasing force configured to maintain the first part coupling elements in the unconnected configuration. In the present embodiment, the biasing elements are magnetic elements 380 or magnets that provide an electromagnetic force that continuously apply a biasing force on the first coupling elements 351, 352 in the direction of line B. in the present embodiment, the first part housing includes three magnets 380 (however, only two are illustrated based upon the orientation of the figure). As illustrated in FIG. 5A, the magnets 380 are positioned below the insulating or nonconductive body. In the present embodiment, magnets or biasing elements 380 are fixed. On the other hand, the first part coupling elements coupled to the nonconductive body is capable of translating within the mouth 312, 316. As illustrated in FIG. 5A, when in the unconnected configuration, the hot or live leg contact surface 325 is not connected or does not contact the hot leg contacting surface 345 of the contacting elements and the neutral leg contact surface 335 of the neutral coupling element does not contact the neutral leg contact surface 340 of the contacting element, which as a result electrical current cannot flow from the power source to the coupling elements if the electrical connector is connected to a power source.

FIG. 5B illustrates the electrical connector in the connected configuration. FIG. 5B is a side view of conductive elements of the first part and the second part in the connected configuration. FIG. 6 is a cross-sectional side view of the first and second parts of the electrical connecter coupled to each other and in the connected configuration, according to a non-limiting example embodiment. FIGS. 5B and 6 will be discussed together. In FIG. 5B, the first part and second housings are not shown for illustrative purposes. In the connected configuration, each first part coupling element 351, 352 conductively couples with one of the contacting elements 306, 311. The second housing 120 also houses at least one magnetic element 390 that provides a magnetic force. The magnetic force is configured in such that it attracts metallic elements in the direction of line C. The magnetic force of magnetic element 390 is such that is greater than the biasing force of magnetic elements or biasing elements 380 of the first part. As a result, when the first part housing and second part housing are within a sufficient proximity, the magnetic force provided by the magnetic element 390 that is greater than the force of magnetic or biasing elements 380 moves and maintains the first part coupling elements 351, 352 into the connected configuration and couple the first part housing to the second part housing. In the connected configuration, the first part coupling elements 351, 352 are conductively coupled and contact with the first part contacting elements 306, 311. More specifically, first part hot leg contact surface 325 contacting coupled with the contact surface 345 of the hot leg contacting element; and, the neutral leg contact surface 335 contacts the neutral leg contact surface 340 of the contacting element. Additionally, in the connected configuration, the first part coupling elements are conductively coupled with the second part coupling elements providing a path for electrical current to flow from the first part contacting elements 311, 306 to the second part coupling elements. In the connected configuration, as illustrated, when the second part is coupled with the first part, the second part protruding element 207 of the second part coupling element protrudes beyond the first surface 430 of the first side of the second part housing and into the first aperture or opening 205. When within sufficient proximity of each other, because of the electromagnetic force that pulls the coupling elements in the direction of line C, the first protruding element 320 of the hot leg coupling element contacts the second part protruding element 207 such that an electrical path is provided between the hot leg coupling element 352 and the second part protruding element. Additionally, because of the magnetic force provided by magnetic element 390, the second protruding element 330 of the neutral leg coupling element contacts the ring 420 such that an electrical path is provided between the neutral leg coupling element 351 and the ring 420. As a result, when the first and second parts are within a sufficient proximity, the magnetic force provided the magnetic element 390 moves the first part coupling elements 351, 352 in the direction of line C and (into the upward sections of the mouths 316, 312) into the connected configuration as illustrated in FIGS. 5B and 6 such that an electrical path is created for power to flow from the pronged sections 305, 310 of the contacting elements to the second part protruding element 207 and ring 420, respectively. Additionally, once the magnetic force of the magnetic elements 390 couples the first part housing with the second part housing, the configuration of the first part ground connecting element is such that the first part ground connecting element terminating end 350 conductively couples with the second part ground connecting element or outer ring 415 thereby creating a path for electrical current to flow from the first part ground connecting elements to the second part ground connecting element. Additionally, as illustrated in FIG. 5A, the first part ground connecting element is further coupled to conductors 525 so that it can be connected to additional conductors via a fastening feature 515 to conductively couple with the ground leg of an electrical appliance plug when said plug is inserted into the opening 122 of the second part. Similarly, the second part protruding element couples with a connection 505 such that it can be fastened to a coupling feature 522 to conductively couple with the hot leg of an appliance plug when said plug is inserted into the opening 122, 123 of the second part. Similarly, the ring 420 couples with a coupling feature 510 for conductively coupling with elements used to contact the neutral leg of an electrical appliance plug when said plug is inserted into the opening 122, 123 of the second part.

In operation, in order to decouple the first part and second part when coupled to each other, a force must be applied in order to overcome the magnetic force provided by the magnetic element 390. If such force is applied and the second part is removed, then the first part coupling elements moves towards the biasing elements or magnetic elements 380 and into the unconnected configuration due to the biasing force provided by biasing member 380. As mentioned above, in the unconnected configuration, the first part coupling elements 351, 352 are not conductively coupled with the contacting elements 306, 311 and as a result electrical path is not created for electrical current to flow to the second part.

Also worth noting is that the device is configured such that the first part coupling elements remain within the first part housing both the connected and an unconnected configuration. In the connected configuration as illustrated in FIG. 6, the second part protruding element 207 enters into the aperture 205 in order to couple with the hot leg first protruding element 320. Additionally, when in the connected configuration and when ring 420 is received within the channel 210, the ring contacts the terminating end 330 of the second protruding element of the neutral leg coupling element. Additionally, when the first part coupling elements move into the connected configuration from the unconnected configuration, and audible sound is created by the coupling elements contacting or hitting the contacting elements, which in one embodiment may be a snapping sound, a popping sound, a clicking sound etc.

The magnets used for the biasing elements and the magnetic elements may be neodymium iron boron (NdFeB), samarium cobalt (SmCo), alnico, and ceramic ferrite magnets, or natural. Additionally, other elements may also be used and are within the spirit and scope of the present invention. Additionally, while magnetic elements use our cylindrical in shape, it is understood that other shapes may also be used such as a horseshoe, ring, rod, square shaped magnet, spherical etc. It is also understood that other shapes inside magnets or magnetic elements may also be used and are within the spirit and scope of the present invention.

The present embodiments, the biasing elements 380 are magnetic elements. The biasing elements 380 use a magnetic force to provide a biasing force to maintain the first coupling elements in the unconnected configuration as illustrated in FIG. 5A. However, other elements may be used to provide such biasing forces. For example, a resilient material having a force that continuously biases towards the direction of Line C may also be used. Such biasing materials continuously return to their original shape their forces are applied. Such materials may include spandex, stretch vinyl, nylon, rubber, plastics, etc. It is also understood that other materials may be also used and are within the spirit and scope of the present invention. In one embodiment (not shown), a first end of the biasing element in the form of an elastic strap may be coupled to the second side of the non-conductive body 365 and a second end of the elastic strap may be coupled to a portion of the interior of the housing and proximate to the prong side of the first part housing. The resilient forces of the elastic will continuously pull the first part coupling elements into the unconnected configuration (lower ends of the mouths 316, 312). Additionally, other biasing elements may also be used and are within the spirit and scope of the present invention.

Additionally, having the live and neutral first part coupling elements 352, 351 coupled or attached to a non-conductive body provides an additional safety feature. Because the first part coupling elements are both coupled to the same non-conductive surface, the first part coupling elements are configured to conductively de-couple from the power source if a mechanical force is applied to either coupling element in substantially the same direction as the first biasing force. For example, if the second part is not coupled to the first part, the first part coupling elements will be in the unconnected configuration. In the unconnected configuration (with the second part removed), if a person were to place a magnetic element that provides a force (as illustrated as line C in FIG. 5B) opposing the biasing force (represented by line B in FIG. 5B) provided by the first part biasing elements 380, then the first part coupling elements may move in the connected configuration ("Artificially Connected Configuration). In the Artificially Connected Configuration, if a person were to apply a mechanical force, greater than the force provide by the magnetic element promoting the Artificially Connected Configuration, to either the live or neutral first part coupling element in substantially the same direction as the biasing force (represented by line B in FIG. 5B) provided by the first part biasing elements 380, then both the live and neutral first part coupling elements would conductively de-couple from the power source.

Figure 11A:
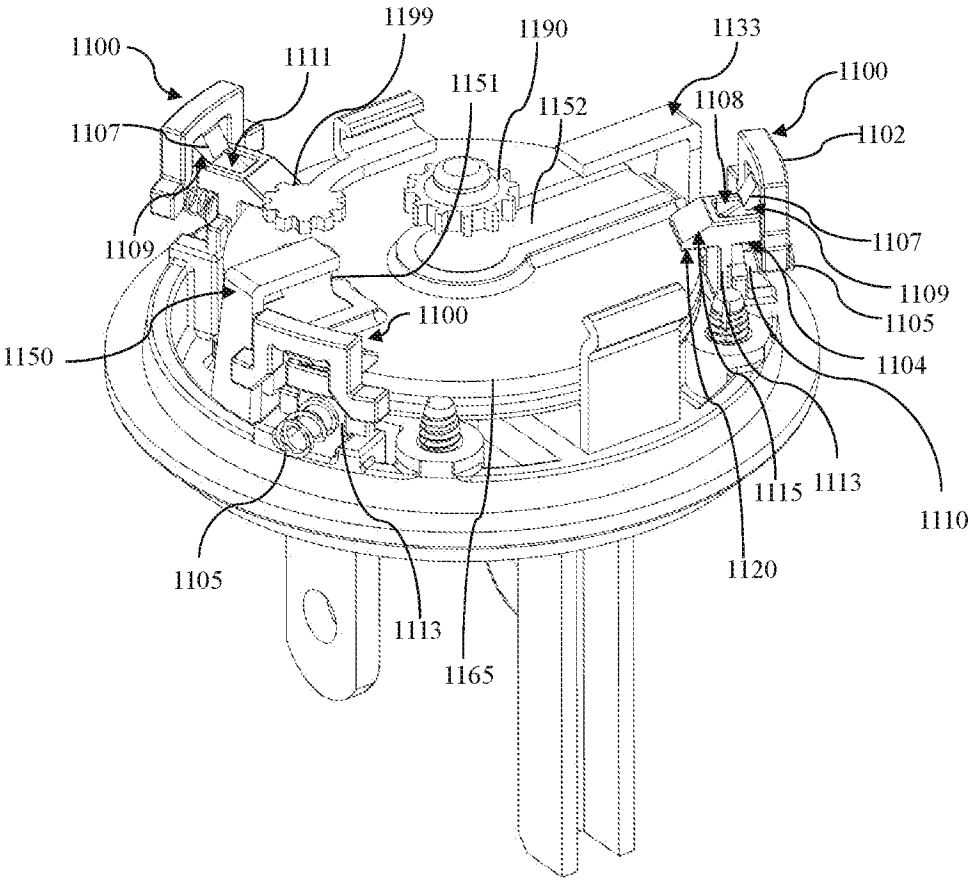
FIG. 11A is a perspective view of the first part of the electrical connector in an unconnected configuration with portions of the first part housing removed for illustrative purposes, according to another non-limiting example embodiment.
Figure 11B:
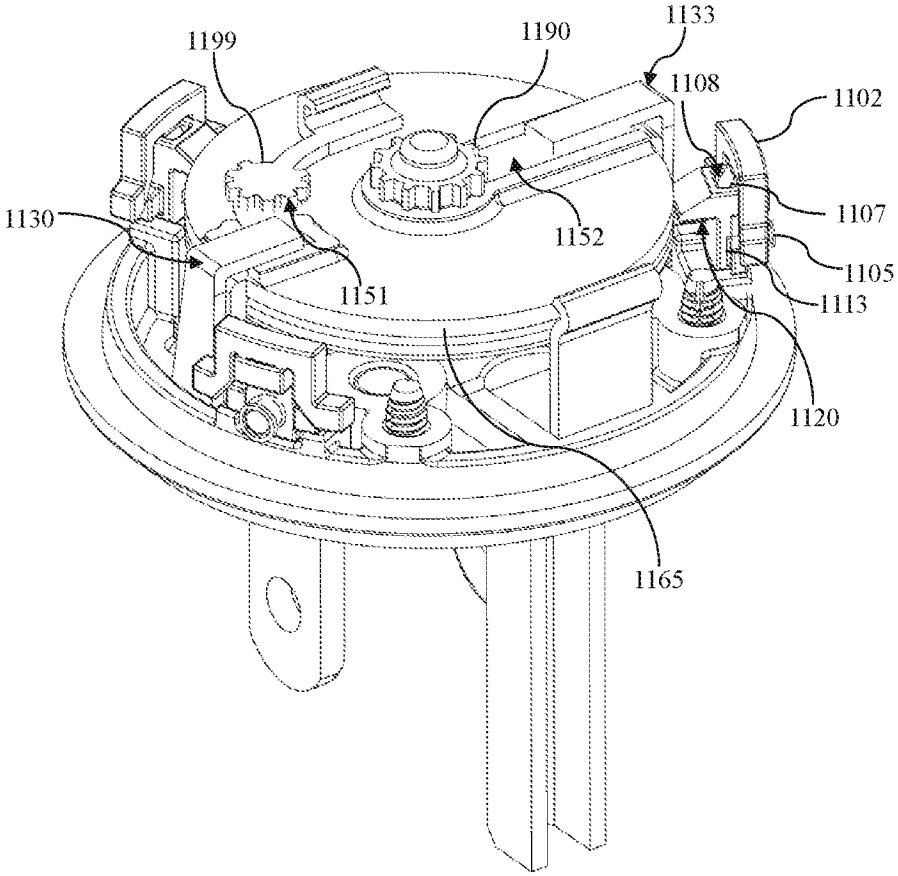
FIG. 11B is a perspective view of the first part of the electrical connector in a connected configuration with portions of the first part housing removed for illustrative purposes, according to another non-limiting example embodiment.
Figure 11C:
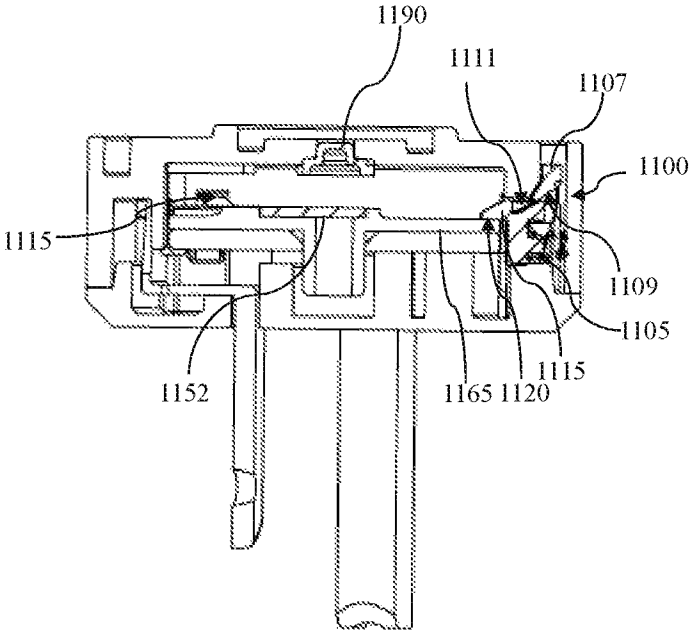
FIG. 11C is a cross-sectional side view of the first part of the electrical connector in an unconnected configuration taken along line A, according to another non-limiting example embodiment; and, FIG. 11D is a cross-sectional side view of the first part and second part of the electrical connector in a connected configuration taken along line A, according to another non-limiting example embodiment.

Moving to FIGS. 11A and 11C, FIG. 11A is a perspective view of the first part of the electrical connector in an unconnected configuration with portions of the first part housing removed for illustrative purposes, according to another non-limiting example embodiment; and, FIG. 11C is a cross-sectional side view of the first part of the electrical connector in an unconnected configuration taken along line A, according to another non-limiting example embodiment. FIGS. 11A and 11C will be discussed together because both figures illustrate another example embodiment of the present invention in the unconnected configuration. FIGS. 11A and 11C also illustrate a locking feature 1100 that is configured to further prevent the coupling elements from unwantedly moving into the connected configuration. FIGS. 11A and 11C illustrate the locking feature in the locked configuration. Portions of the first part housing 110 have been removed for illustrative purposes. The locking feature comprises an upper latch body 1102 and a lower latch body 1104. The upper locking body is positioned inside the first part housing and configured to translate downwards and upwards. The upper latch body comprises a tooth 1107 having a slanted surface 1109. As will be further explained below, the slanted surface 1109 of the tooth is configured to mate with the slanted surface 1111 of the lower latch body. In the locked configuration, the tooth 1107 is positioned at the upper end of the slanted surface 1111 of the lower latch body.

The lower latch body 1104 includes a latch arm 1115 and has a cutout 1108 defining a slanted surface 1111 that is configured to mate with slanted surface 1109 of the tooth. A tubular or cylindrical shaped body 1110 is surrounded by a compression spring 1105. The compression spring is configured such that one end of the compression spring abuts a vertical feature 1113 of the lower latch body and the other end of the compression spring abuts the inside surface of the first part housing. The lower latch body is configured to move inwards and outwards. The compression spring is configured to continuously apply a biasing force inwards towards the center of the electrical connector. As the biasing spring pushes inwards, it pushes against the vertical feature 1113 of the lower latch body. As is illustrated in FIGS. 11A and 11C, in the locked configuration, a downward facing surface 1120 of the arm is configured to be positioned above or abuts the nonconductive body 1165 and acts as a stopping feature to further prevent the nonconductive body and coupling elements 1152, 1151 from inadvertently or unwantedly moving into the connected configuration.

Figure 11D:
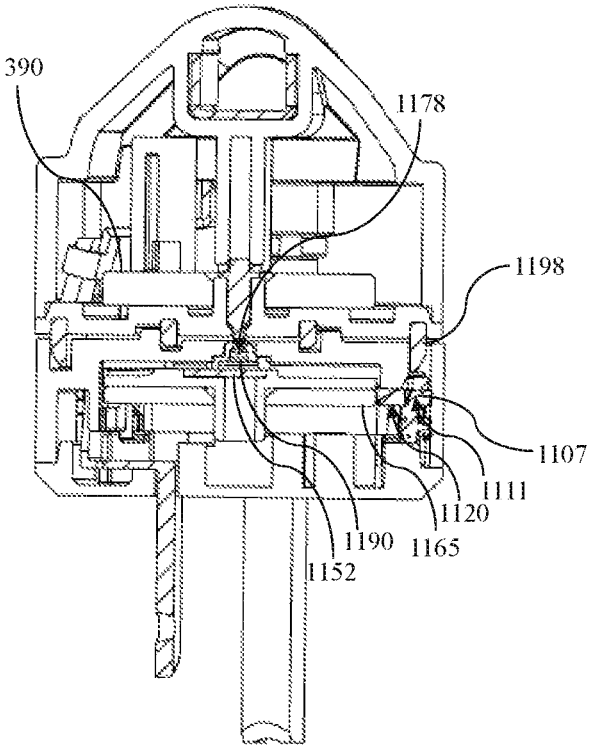

FIGS. 11B and 11D will be discussed together. FIG. 11B is a perspective view of the first part of the electrical connector in a connected configuration with portions of the first part housing and the second part removed for illustrative purposes, according to another non-limiting example embodiment; and, FIG. 11D is a cross-sectional side view of the first part and second part of the electrical connector in a connected configuration taken along line A, according to another non-limiting example embodiment. FIGS. 11B and 11B also illustrates the locking feature in the unlocked configuration. In the unlocked configuration, the tooth 1107 of the upper latch body is positioned at the lower or bottom end of the cutout 1108 of the lower latch body. In the connected configuration when the second part is coupled with the first part, the ground connecting element 1998 abuts the upper latch body 1102 and provides a force forcing the tooth downwards and into the bottom or lower end of the cutout. When the tooth is in the bottom or lower end of the cutout, the tooth acts against the wall s of the cutout preventing the compression spring from pushing the vertical feature 1113 inward. As a result, the latch arm 1115 is positioned outward from the nonconductive body 1165 such that the surface 1120 of the latch arm does not stop or prevent the nonconductive body from moving upwards as illustrated in FIGS. 11B and 11D.

In the present embodiment, the second part coupling elements also includes conductive covering 1190, 1199. These conductive coverings are configured to be positioned along the openings of the second part housing (205, 220, respectively). These conductive coverings also act as a safety feature so that foreign objects may not be inserted into the openings 205, 220. The conductive coverings are configured such that when the second part live or hot leg coupling element and neutral leg coupling element contact the conductive coverings and the first part coupling elements are in the connected configuration, a path for electrical current to flow from a power source to the second part is provided. The conductive coverings may comprise conductive material such as aluminum, copper, iron, gold, silver, brass, graphite, electrolytes, conductive polymers, etc. Additionally, other conductive materials having properties to allow electrical current to flow may also be used and are within the spirit and scope of the present invention.

As illustrated in FIGS. 11B and 11D in the unlocked position, the first part coupling elements 1151, 1152 are in the connected configuration such that the first part coupling elements are conductively coupled with the second part coupling elements via the conductive coverings. As is illustrated in FIG. 11D, in the connected and an unlocked configuration, the second part is coupled with the first part. When the second part is removed, by applying a force great enough to overcome the magnetic attraction of the magnetic element 390 of the second part, the biasing force of the biasing elements 380 of the first part pulls the nonconductive body 1165 and the first part coupling elements downwards into the unconnected configuration as illustrated in FIGS. 11A and 11C. Shortly thereafter when the second part is removed, the inward force provided by compression spring 1105 forces the vertical feature 1113 of the lower latch body inwards. As a lower latch body moves inwards, the tooth 1107 of the upper latch body rides up the slanted surface 1109 and moves upward to the upper end of the cutout 1108 due to the configuration of the slanted surfaces 1109 and 1111 pushing the upper latch body upwards as illustrated in FIGS. 11A and 11C. As the force of the compression spring forces the latch arm 1115 inward, the surface 1120 of the latch arm moves into position above the nonconductive body 1165 such that surface 1120 acts as a safety and stopping feature to prevent unwanted movement of the nonconductive body and first part coupling elements into the connected configuration.

Figure 7:
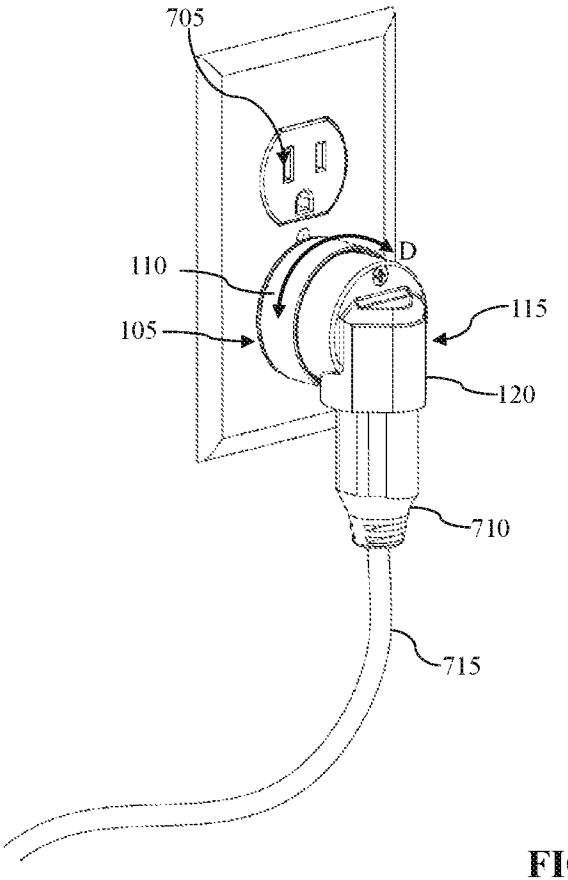
FIG. 7 is a perspective view of an electrical cord inserted into the second part of second embodiment of the electrical connector, wherein the electrical connector is conductively coupled with a wall socket, according to a non-limiting example embodiment.

Moving to FIG. 7, FIG. 7 is a perspective view of an electrical cord inserted into the second part of second embodiment of the electrical connector, wherein the electrical connector is conductively coupled with a wall socket, according to a non-limiting example embodiment. In FIG. 7, the first part 105 has been inserted into a 120 V socket. The pronged sections of the contacting elements are not shown in FIG. 7. The prong section of electrical power cord electrical power cord 715 has been inserted into the opening 123 of the second part. While not able to be seen in FIG. 7, the magnetic element 390 of the second part continuously pulls and maintains the first part coupling element 351, 352 into the connected configuration such that a continuous path for electrical power to flow from the pronged elements 305, 310 (hot leg, neutral leg) of the first part and into the pronged elements (hot leg, neutral leg) of the electrical power cord. Additionally, the ground connecting element or prong 315 of the first part is conductively coupled to the ground element or prong of the electrical power cord. The circular or cylindrical shaped housing of the second part 115 as well as the configuration of the receiving surfaces and channels (illustrated in FIG. 2, for example) of the first part housing 110 is configured such that when the second part is coupled with the first part, the second part housing is able to rotate 360° within the first part housing in the direction of curved line D the when the magnetic force couples the first part housing to the second part housing. The rotational feature is helpful for people with physical disabilities. In operation, a user may insert the pronged components of the first part housing into the receiving part 705 of an electrical outlet. This only has to be completed one time as opposed to every time a person needs to plug in or unplug an electrical power cord in an electrical outlet. Next a user can easily insert the male end of electrical power cord into the openings on the second part housing. For persons with disabilities, a person may carry out this step in a manner most suitable for them. For example, if a person is elderly, a person does not have to bend down to insert the male end of the power cord into a socket every time it is necessary to plug in a device. Using the present invention, a person only has to move the second part close to or within sufficient proximity for the magnetic element supported by the second part housing to couple with the first part housing 110. This can make it much easier for a person with physical disabilities to connect electrical devices to power sources. Also because of the rotational feature mentioned above, a person can also easily rotate the power cord to a desired position by applying a sufficient force to rotate the body of the second part housing relative to the first part. Additionally, in operation, in order to remove or disconnect the electrical power cord and second part from the first part of the electrical connector, a user only has to apply force sufficient to overcome the magnetic force provided by the magnetic element 390 of the second part to decouple the second part from the first part. As a result, a person with physical disabilities can easily decouple the second part from the first part without having to bend down or to reach up in high places in order to remove the male portion of electrical power cord from electrical outlet.

Figure 8A:
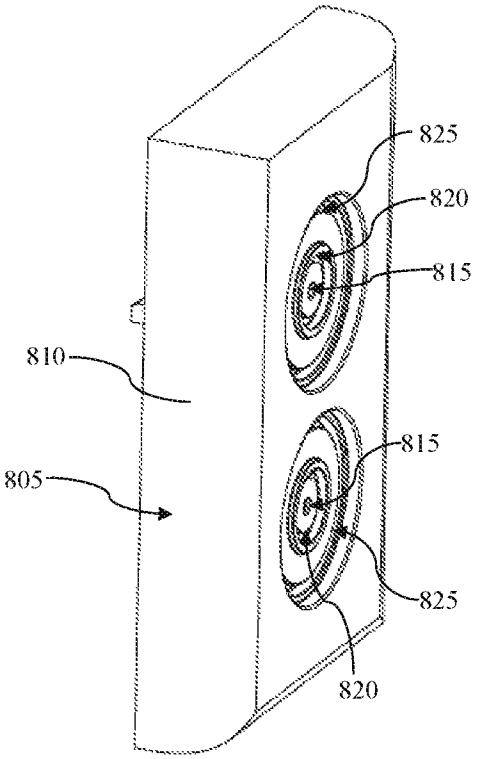
FIG. 8A is a perspective view of another embodiment of the first part of electrical connector, according to a non-limiting example embodiment.
Figure 8B:
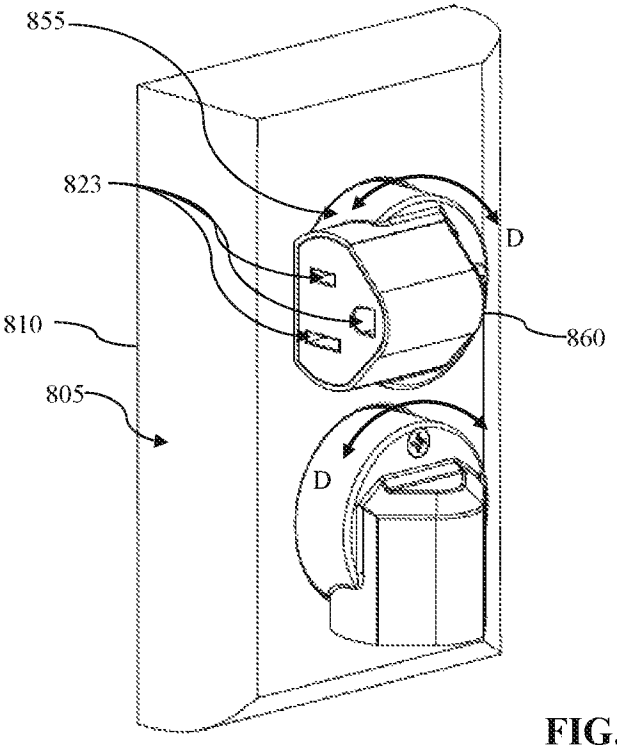
FIG. 8B is a perspective view of another embodiment of multiple second parts conductively coupled with first part of electrical connector, according to a non-limiting example embodiment.

FIGS. 8A and 8B illustrate different non-limiting embodiments how the electrical connector may be configured. FIG. 8A is a perspective view of another embodiment of the first part 805 of electrical connector, according to a non-limiting example embodiment. FIG. 8A illustrates that the first part housing may be configured to receive to second part. Additionally, it is also understood that the first part housing also be configured to receive additional second parts. Similar to the previously described embodiments, in FIG. 8A the first part housing is configured to receive multiple second parts. In FIG. 8A, the first part includes the central opening 815, first channel 820 and second channel 825. Although not shown, the component supported inside of the first part housing illustrated in FIG. 8A are configured to allow the first part coupling elements (not shown) to move between the unconnected configuration and connected configuration. Additionally, similar to the other embodiments, a second part (not shown in FIG. 8A) having one magnetic element providing a force greater than the biasing force of the biasing elements of the first part is configured to move and maintain the first part coupling elements into the connected configuration and couple the first part housing to the second part housing when the second part (not illustrated in FIG. 8A) is within a sufficient proximity. Similar to the other embodiments, the first part may be configured to be conductively coupled via pronged elements into the receiving end of the electrical socket. As a result, when in the connected configuration, the embodiment illustrated in FIG. 8A provides a path for electrical current to flow from a power source to the first part coupling elements and into multiple second parts when in the connected configuration. When in the unconnected configuration, similar to the previously described embodiments, the first part coupling elements remain substantially within the first part housing when in the connected configuration. Also worth nothing is that the first part may be configured so that the multiple second parts can be used.

FIG. 8B is a perspective view of another embodiment of multiple second parts 855 conductively coupled with first part of the electrical connector, according to a non-limiting example embodiment. As illustrated in FIG. 8B, the second part 855 of the coupled to the first part 805. As mentioned above, the circular or cylindrical shaped housing of the second part as well as the configuration of the receiving surfaces and channels of the first part is such that when the second part is coupled with the first part, the second part is able to rotate 360° within the first part housing in the direction of curved line D when the magnetic force couples the first part housing to the second part housing. The rotational feature is helpful for people with physical disabilities as mentioned above.

Figure 9:
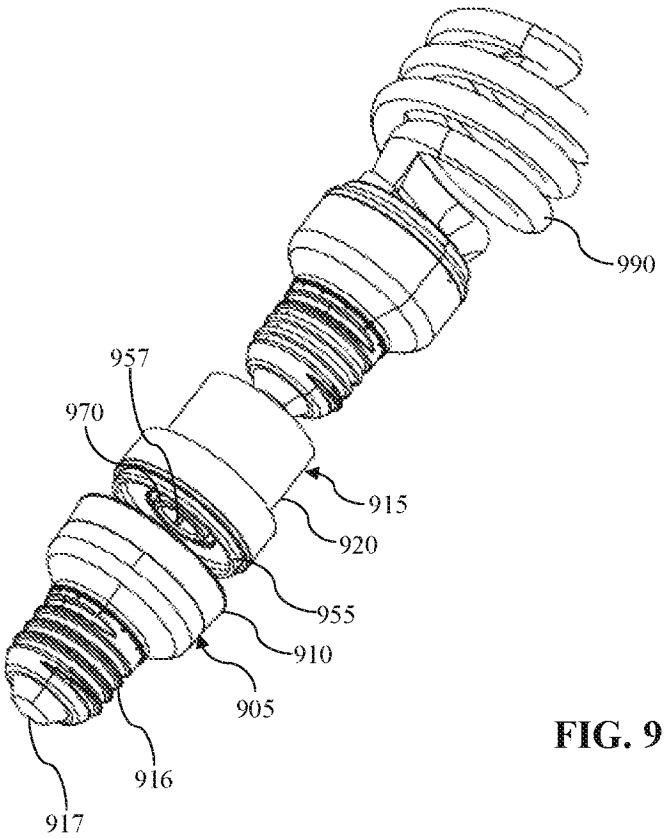
FIG. 9 is an exploded perspective view of another embodiment of the first part and second part of electrical connector, wherein the first part is configured to be coupled with a socket for a light emitting device and the second part is coupled to a light emitting device, according to a non-limiting example embodiment.

FIG. 9 is an exploded perspective view of another embodiment of the first part 905 and second part 915 of electrical connector, wherein the first part is configured to be coupled with a socket for a light emitting device (not shown) and the second part is coupled to a light emitting device 990, according to a non-limiting example embodiment. FIG. 9 illustrates that the first part housing contacting elements may include embodiments other than the pronged elements described above. In this present embodiment, a foot contact 917 may be the live leg or hot leg contacting element that is configured to conductively couple with the live leg or hot leg coupling element within the first part housing 910 when in the connected configuration (as explained above). A spiral contact 916 wrapping around the cylindrical body of the housing may be the neutral contacting element that is configured to conductively couple with the neutral coupling element within the first part housing 910 when in the connected configuration (as explained above). Similar to above, the spiral contact 916 and foot contact 917 are configured to provide a path for electrical current to flow from power source to an electrical device when the connected configuration. Additionally, certainly as explained above, when in the unconnected configuration the coupling elements are decoupled from the contacting elements within the first part housing 910 and therefore a path for electrical current to flow from electrical power source to an electrical device is not established. In the present embodiment, the second part housing 920 includes an opening that is configured for receiving a light emitting device or bulb 990. FIG. 9 illustrates the versatility of devices that may be coupled to or use with the electrical connector. Similar to the other embodiments, the second part housing also supports second part coupling elements 957, 970 that are configured to conductively couple with the first part coupling elements supported by the first part housing. Similar to the above non-limiting embodiments, in the present embodiment, the second protruding element 957 extends beyond the first surface of the first side second part housing. A ring 970 protrudes from the first surface of the first side of the second part housing and surrounds the second protruding element. The second part coupling elements are configured to conductively couple with the first part coupling elements supported by the first part housing 910 when the first part coupling elements are in the connected configuration. In the unconnected configuration, when the second part has been removed from the first part, the first part coupling elements are not conductively couple with the first part contacting elements and therefore a path for electrical power to flow from a power source to the second part is not provided.

Figure 10:
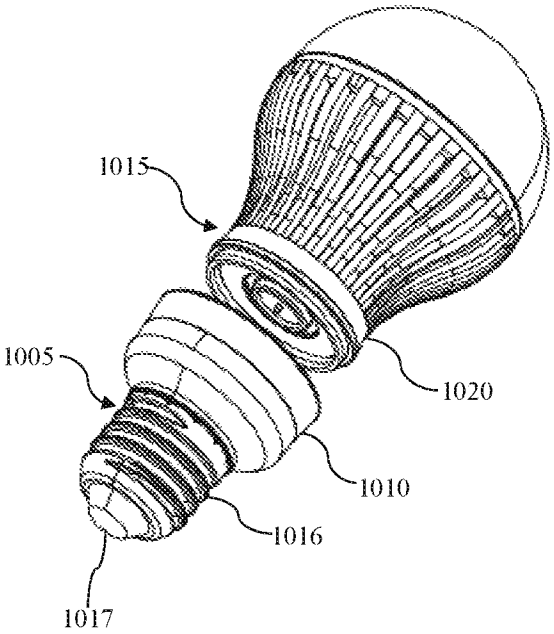
FIG. 10 is an exploded perspective view of another embodiment of the first part and second part of electrical connector, wherein the first part is configured to be coupled with a socket for a light emitting device and the second part is integral with a light emitting device, according to a non-limiting example embodiment.

FIG. 10 is an exploded perspective view of another embodiment of the first part 1005 and second part 1015 of electrical connector, wherein the first part is configured to be coupled with a socket for a light emitting device (not shown) and the second part is integral with a light emitting device, according to a non-limiting example embodiment. In this present embodiment, a foot contact 1017 may be the live leg or hot leg contacting element that is configured to conductively couple with the live leg or hot leg coupling element within the first part housing 1010 when in the connected configuration (as explained above). A spiral contact 1016 may be the neutral contacting element that is configured to conductively couple with the neutral coupling element within the first part housing 1010 when in the connected configuration (as explained above). Similar to above, the spiral contact 1016 and foot contact 1017 are configured to provide a path for electrical current to flow from power source to an electrical device when the connected configuration. In the present embodiments the light emitting device is integral with the second part housing 1020. Additionally, certainly as explained above, when in the unconnected configuration the coupling elements are decoupled from the contacting elements within the first part housing 1010 and therefore a path for electrical current to flow from electrical power source to an electrical device is not established.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. An electrical connector for connecting a power source to an electrical device comprising:

a first part housing configured for supporting:

a plurality of contacting elements each configured to conductively couple with a plurality of contacts of the electrical power source;

a plurality of first part coupling elements each having conductive properties and configured to move between a connected configuration and an unconnected configuration, wherein in the unconnected configuration the first part coupling elements receive no electrical current;

wherein in the connected configuration each first part coupling element conductively couples with one of the contacting elements, and wherein in the unconnected configuration the first part coupling elements are not conductively coupled with the contacting elements;

at least one first magnetic element, wherein the at least one first magnetic element provides a first magnetic force configured to maintain the first part coupling elements in the unconnected configuration; a second part housing configured for supporting:

a plurality of second part coupling elements each configured to conductively couple with one of the first part coupling elements when the first part coupling elements are in the connected configuration;

at least one second magnetic element providing a second magnetic force greater than the first magnetic force such that when the first part housing and the second part housing are within a sufficient proximity the second magnetic force moves and maintains the first part coupling elements into the connected configuration and couple the first part housing to the second part housing; and, wherein in the connected configuration the first part coupling elements are conductively coupled with the second part coupling elements and the first part contacting elements such that electrical current can flow from the contacting elements to the second coupling elements.

2. The electrical connector of claim 1, wherein the contacting elements include least a hot leg contacting element and a neutral leg contacting element.

3. The electrical connector of claim 2, wherein first part housing further includes a non-conductive body on which the first part coupling elements are disposed.

4. The electrical connector of claim 3, wherein the first part coupling elements comprises:

a first part hot leg coupling element, the first part hot leg coupling element comprising a hot leg contact surface for conductively coupling with the hot leg contacting element when in the connected configuration, and a first protruding element that protrudes above the surface of the non-conductive body; and, a neutral leg coupling element, the neutral leg coupling element comprising a neutral leg contact surface for conductively coupling with the neutral leg contacting element when in the connected configuration, and a second protruding element protruding above the non-conductive body.

5. The electrical connector of claim 1, wherein the second part coupling elements comprises:

a second part protruding element protruding beyond a first surface of a first side of the second part housing; and, a ring protruding from the first surface of the first side of the second part housing, wherein the ring surrounds the second part protruding element.

6. The electrical connector of claim 1, wherein the first part further includes a first part ground connecting element, wherein the second part further includes a second part ground connecting element, and wherein the first part ground connecting element conductively couples with the second part ground connecting element when the first part housing is coupled with the second part housing.

7. The electrical connector of claim 1, wherein the first part includes three first magnetic elements.

8. The electrical connector of claim 1, wherein the first part housing further supports a locking feature configured to move between a locked configuration and an unlocked configuration, wherein in the locked configuration a latch further prevents the coupling elements from moving into the connected configuration, and wherein in the unlocked configuration the latch does not prevent the coupling elements from moving into the connected configuration.

9. The electrical connector of claim 1, wherein the first part coupling elements remain substantially within the first part housing in both the connected configuration and unconnected configurations.

10. The electrical connector of claim 1, wherein the first part housing and second part housing are configured to rotate relative to the first part housing when the magnetic force couples the first part housing to the second part housing.

11. The electrical connector of claim 1, wherein the first part housing and second part housing are configured to rotate 360 degrees relate to the first part housing when the magnetic force couples the first part housing to the second part housing.

12. The electrical connector of claim 1, wherein an audible sound is produced when the first part coupling elements move into the connected configuration.

13. The electrical connector of claim 5, wherein the second part protruding element comprises a second biasing element configured to continuously force a terminating end of the second part protruding element above the first surface of the housing.

14. The electrical connector of claim 4, wherein the second protruding element comprises a third biasing element configured to continuously force a terminating end of the second protruding element away from the surface of the non-conductive body.

15. The electrical connector of claim 1, wherein the first part coupling elements, when conductively coupled with the power source, are configured to conductively de-couple from the power source if a mechanical force is applied to either coupling element in substantially the same direction as the first magnetic force.

16. An electrical connector for connecting a power source to an electrical device comprising:

a first part housing configured for supporting:

a plurality of contacting elements each configured to conductively couple with a plurality of contacts of the electrical power source;

a plurality of first part coupling elements each having conductive properties and configured to move between a connected configuration and an unconnected configuration, wherein in the connected configuration each first part coupling element conductively couples with one of the contacting elements, and wherein in the unconnected configuration the first part coupling elements are not conductively coupled with the contacting elements;

at least one first magnetic element, wherein the at least one first magnetic element provides a first magnetic force configured to maintain the first part coupling elements in the unconnected configuration, wherein in the unconnected configuration the first part coupling elements receive no electrical current;

a non-conductive body comprising non-conductive material on which the first part coupling elements are disposed;

a second part housing configured for supporting:

a plurality of second part coupling elements each configured to conductively couple with one of the first part coupling elements when the first part coupling elements are in the connected configuration; and, at least one second magnetic element providing a second magnetic force greater than the first magnetic force such that when the first part housing and the second part housing are within a sufficient proximity the second magnetic force moves and maintains the first part coupling elements into the connected configuration and couple the first part housing to the second part housing, wherein in the connected configuration the first part coupling elements are conductively coupled with the second part coupling elements and the first part contacting elements such that electrical current can flow from the contacting elements to the second coupling elements.

17. The electrical connector of claim 16, wherein the contacting elements include least a hot leg contacting element and a neutral leg contacting element.

18. The electrical connector of claim 17, wherein the first part coupling elements comprises:

a first part hot leg coupling element, the first part hot leg coupling element comprising a hot leg contact surface for conductively coupling with the hot leg contacting element when in the connected configuration, and a first protruding element that protrudes above the non-conductive body; and, a neutral leg coupling element, the neutral leg coupling element comprising a neutral leg contact surface for conductively coupling with the neutral leg contacting element when in the connected configuration, and a second protruding element that extends above the non-conductive body.

19. The electrical connector of claim 16, wherein the second part coupling elements comprises:

a second part protruding element protruding beyond a first surface of a first side of the second part housing; and, a ring protruding beyond the first surface of the first side of the second part housing, wherein the ring surrounds the second part protruding element.

20. The electrical connector of claim 15, wherein the first part housing further supports a first part ground connecting element, wherein the second part further includes a second part ground connecting element, and wherein the first part ground connecting element conductively couples with the second part ground connecting element when the first part housing is coupled with the second part housing.

* * * * *